US005535852A

United States Patent [19]

Bishop et al.

[11] Patent Number: 5,535,852

[45] Date of Patent: Jul. 16, 1996

[54] LIFT APPARATUS

[76] Inventors: David J. Bishop, 821 Revere Way West, Bartlesville, Okla. 74006; Carroll E. Sherwin, 10112 Samantha Ct., Oklahoma City, Okla. 73162

[21] Appl. No.: 291,716

[22] Filed: Aug. 17, 1994

[51] Int. Cl.[6] ..... B66B 13/24

[52] U.S. Cl. ..... 187/336; 312/247

[58] Field of Search ..... 187/336, 406, 187/408; 312/247, 246

[56] References Cited

U.S. PATENT DOCUMENTS

| | | | |
|---|---|---|---|
| 2,086,002 | 7/1937 | Shepard | 187/17 |
| 2,499,791 | 3/1950 | Spencer | 312/247 |
| 3,608,674 | 9/1971 | Phillips | 187/3 |
| 3,627,397 | 12/1971 | Rocninsky | 312/246 |
| 3,743,287 | 7/1973 | Liermann | 273/5 B |
| 4,060,292 | 11/1977 | Medina | 312/247 |
| 4,412,601 | 11/1983 | Cooper | 187/27 |
| 5,020,641 | 6/1991 | Olsen et al. | 187/408 |
| 5,203,619 | 4/1993 | Welsch et al. | 312/247 |

FOREIGN PATENT DOCUMENTS

| | | | |
|---|---|---|---|
| 1096111 | 6/1955 | France | 312/247 |

*Primary Examiner*—Kenneth Noland
*Attorney, Agent, or Firm*—William R. Sharp

[57] ABSTRACT

A lift apparatus is provided for raising or lowering objects through an opening in a ceiling which has associated ceiling supports, such as ceiling joists. The lift apparatus includes a frame, mounted to and supported by the ceiling supports, having first and second frame members, and a third frame member which extends between and is fixedly connected to the first and second frame members. A receptacle, for holding the objects and sized to fit through the ceiling opening, is fixedly connected to a movable guide mechanism slidably cooperating with at least one of the first or second frame members to allow substantially vertical movement of the receptacle between a retracted position, substantially above ceiling level, and an extended position substantially below ceiling level. At least one pulley and a device, such as a motor, for rotating the pulley(s) are fixedly mounted to the third frame member and operate at least one cable connected between the pulley(s) and receptacle to raise or lower the receptacle through the ceiling opening between the retracted and extended positions. The lift apparatus is particularly useful for raising objects to or lowering objects from a home attic.

15 Claims, 2 Drawing Sheets

LIFT APPARATUS

BACKGROUND OF THE INVENTION

This invention relates to a lift apparatus for raising or lowering objects relative to a ceiling in a building, such as a house, and is particularly applicable to raising objects into or lowering objects from a home attic.

Houses that have an attic typically provide access to the attic by means of an opening through the ceiling and an associated ladder which is extendable from the ceiling opening to the floor. Transporting objects, such as boxes or other storage items, to or from the attic can be extremely difficult or even dangerous when a person attempts to climb the ladder while carrying the objects.

SUMMARY OF THE INVENTION

It is, therefore, an object of the invention to provide a lift apparatus which can safely and easily raise or lower objects to or from an attic or other space above ceiling level.

It is also an object of the invention to provide such a lift apparatus which is simple in construction, inexpensive, and easy to install.

The above objects of the invention are achieved by a lift apparatus for raising or lowering objects relative to a ceiling, wherein the ceiling has a ceiling support means associated therewith and an opening therethrough having opposing sides, the lift apparatus comprising: a receptacle, for holding the objects, which is sized to fit through the ceiling opening; a frame, mounted to and supported by the ceiling support means in a fixed position, which includes (i) an elongated and substantially vertically oriented first frame member having a lower end in close proximity to one side of the ceiling opening, (ii) an elongated and substantially vertically oriented second frame member having a lower end in close proximity to the other, opposing side of the ceiling opening, and (iii) a third frame member, positioned above the ceiling opening, extending substantially horizontally between and fixedly connected to the first and second frame members near or at the upper ends of the first and second frame members; a movable guide means fixedly connected to the receptacle for slidably cooperating with at least one of the first or second frame members so as to allow substantially vertical movement of the receptacle between a retracted position, at which the receptacle and movable guide means are substantially above ceiling level, and an extended position, at which the receptacle and movable guide means are substantially below ceiling level; a drive means, including a pulley and a means for rotating the pulley, mounted to the third frame member; a cable substantially vertically extending between and connected to the pulley and the receptacle so as to be substantially vertically movable by rotation of the pulley to thereby raise or lower the receptacle, and any objects held therein, through the ceiling opening between the retracted and extended positions.

According to another aspect of the invention, there is provided an apparatus comprising: a frame which includes (i) an elongated first frame member having a longitudinal axis and opposing ends, (ii) an elongated second frame member having a longitudinal axis and opposing ends, wherein the longitudinal axis of the second frame member is substantially parallel to and substantially coplanar with the longitudinal axis of the first frame member, (iii) an elongated third frame member having a longitudinal axis substantially perpendicular to the longitudinal axes of the first and second frame members, and extending between and fixedly connected to the first and second frame members near or at one end of each of the first and second frame members, and (iv) a flanged fourth frame member fixedly connected to the first and second frame members at positions spaced from the third member toward the other, opposing ends of the first and second frame members, the fourth frame member including at least two opposing flange portions that lie in a plane substantially perpendicular to the longitudinal axes of the first and second frame members; an elongated first guide member having a longitudinal axis substantially parallel to the longitudinal axis of the first frame member and being slidably connected to the first frame member so as to allow movement of the first guide member relative to the first frame member in opposite directions substantially parallel to the longitudinal axis of the first frame member; and an elongated second guide member having a longitudinal axis substantially parallel to the longitudinal axis of the second frame member and being slidably connected to the second frame member so as to allow movement of the second guide member relative to the second frame member in the above-mentioned opposite directions.

According to a preferred embodiment of the invention hereafter described, the first, second, and third frame members are tubular members, and the guide members are also tubular members that are slidably and telescopically received by the first and second frame members. Such preferred embodiment also employs a motor to rotate a pair of pulleys, and two corresponding cables passing through the first frame member, second frame member, and guide members.

The invention is particularly advantageous for use with a home attic, insofar as it is simple in construction, uses inexpensive components, and is very easy to install. These advantages are very important to the average homeowner interested in economical and useful improvements to his or her home.

DETAILED DESCRIPTION OF THE INVENTION

A preferred embodiment of the invention will now be described with reference to the FIGURES.

Figure 1:
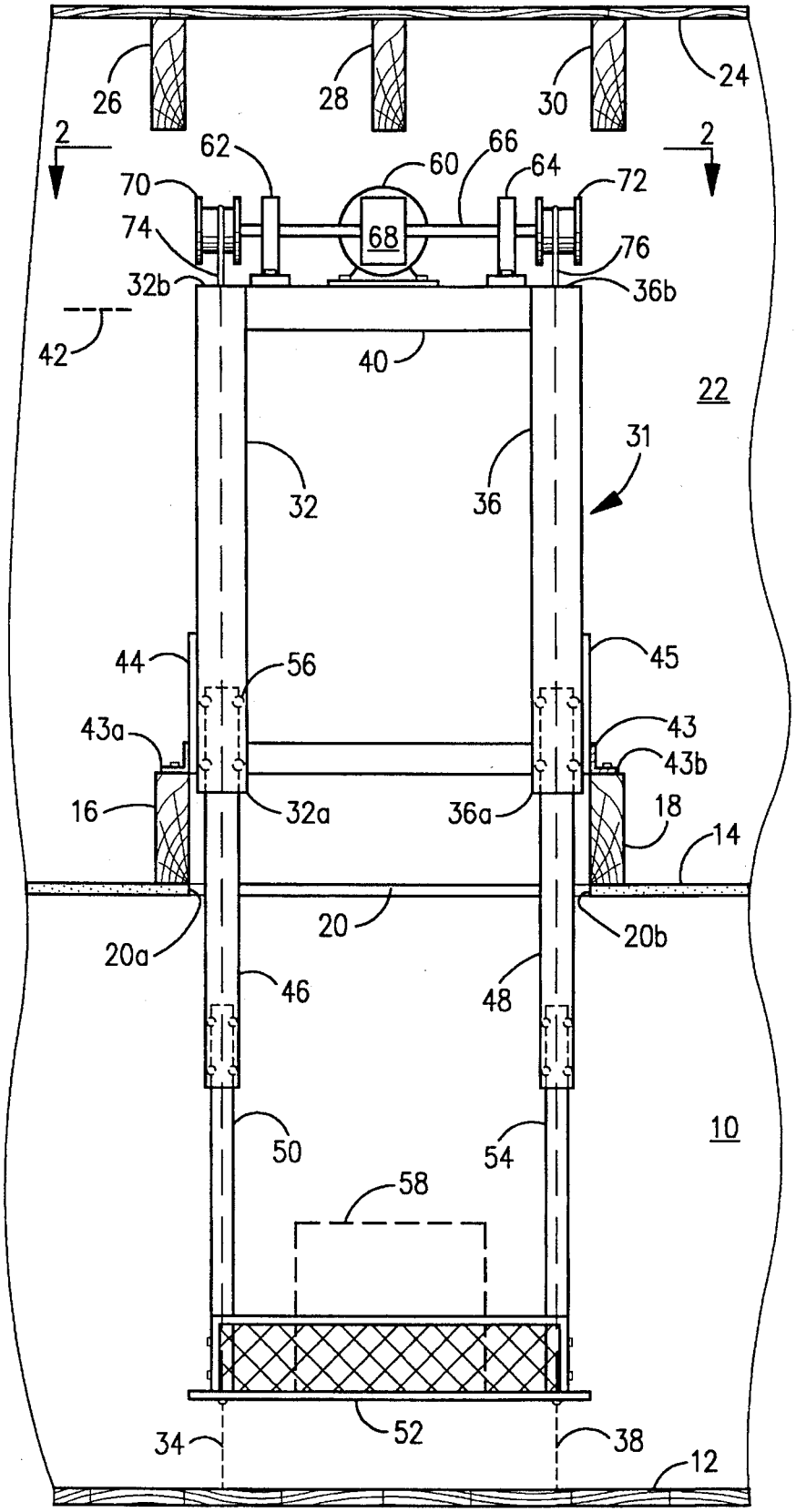
FIG. 1 is a partial cross-sectional view which illustrates a preferred embodiment of a lift apparatus in accordance with the invention. The lift apparatus is shown in its extended position.

Referring to FIG. 1, the illustrated apparatus is shown as being installed in a home having an interior room 10, such as a garage, defined between a floor 12 and a ceiling 14. Ceiling 14, at a vertical level hereafter denoted as ceiling level, is supported by substantially horizontally extending ceiling joists 16 and 18 (among other joists not shown in FIG. 1), and has an opening 20 (more clearly shown in FIG. 2) therethrough which has opposing sides 20*a* and 20*b*. Although only single ceiling joists are shown in the illustrated embodiment, such joists could be doubled if desired for additional strength and reinforcement. An attic 22 is defined between ceiling 14 and roof 24. Roof 24 is supported by roof joists such as those indicated at 26, 28, and 30.

The illustrated apparatus has a frame 31 which includes: (i) an elongated and preferably tubular frame member 32 which is substantially vertically oriented and has a longitudinal axis 34, a lower end 32*a* in close proximity to side 20*a* of ceiling opening 20, and also an upper end 32*b;* (ii) an elongated and preferably tubular frame member 36 which is substantially vertically oriented and has a longitudinal axis 38 substantially parallel to and coplanar with longitudinal axis 34, a lower end 36*a* in close proximity to side 20*b* of ceiling opening 20, and also an upper end 36*b;* (iii) an elongated and optionally tubular frame member 40, positioned above ceiling opening 20, which extends substantially horizontally between and is fixedly connected to the frame members 32 and 36 near or at upper ends 32*b* and 36*b,* and which further has a longitudinal axis 42 substantially perpendicular to longitudinal axes 34 and 38; and (iv) a flanged frame member 43, fixedly connected to frame members 32 and 36 by means of braces 44 and 45 (more clearly shown in FIG. 3) at positions downwardly spaced from frame member 40 toward lower ends 32*a* and 36*a,* which has opposing flange portions 43*a* and 43*b* that lie in a plane substantially perpendicular to longitudinal axes 34 and 38. As shown, flange portions 43*a* and 43*b* lie along and in contact with ceiling joists 16 and 18, respectively, such that such ceiling joists provide support to the frame. The flange portions 43*a* and 43*b* are also shown to be fixedly mounted to the ceiling joists by suitable means, such as screws, to thereby mount frame 31 in a fixed position. It should be apparent from the above discussion and FIG. 1 that no frame member or any part thereof is connected to roof 24 or the associated roof joists.

The frame members as described above are preferably connected together by means of welds for optimum strength and stability. Suitable materials for the frame members include aluminum, steel, or other rigid material capable of supporting loads of up to several hundred pounds. Frame members 32 and 36 are also preferably square or rectangular in cross section.

Elongated and preferably tubular guide member 46 is substantially vertically oriented and is slidably connected to frame member 32 so as to permit substantially vertical movement relative to frame member 32 in opposite, upward and downward directions substantially parallel to longitudinal axis 34. The longitudinal axis of guide member 46 is substantially parallel to and preferably the same as longitudinal axis 34. Therefore, guide member 46 is coaxial with frame member 32, and is further telescopically received by the frame member 32. Similarly, elongated and preferably tubular guide member 48 is oriented and is slidably connected to frame member 36 in the same manner as guide member 46 is oriented and slidably connected to frame member 32 so as to permit substantially vertical movement in the upward and downward directions.

Guide member 50 is an elongated and preferably tubular member slidably connected to the guide member 46 so as to be substantially coaxially and telescopically received by guide member 46 to thereby allow substantially vertical upward or downward movement relative to guide member 46. Guide member 50 is fixedly connected near or at its lower end to a receptacle 52. Similarly, guide member 54 is also an elongated and preferably tubular member slidably connected to guide member 48 so as to be substantially coaxially and telescopically received by guide member 48 to thereby allow substantially vertical upward or downward movement relative to guide member 48. Guide member 54 is also fixedly connected near or at its lower end to receptacle 52.

Therefore, the various guide members cooperate with frame members 32 and 36 so as to allow substantially vertical movement of the receptacle between retracted and extended positions. The extended position is shown in FIG. 1 as having receptacle 52 and the "guide means" as comprised by the guide members substantially below ceiling level. The retracted position is shown and described with reference to FIG. 3 below.

The slidable connections described above with regard to the guide members are most conveniently and effectively accomplished by roller bearings mounted near the upper ends of the guide members. Such roller bearings are shown in dashed lines as indicated at, for example, 56. Of course, stops (not shown) are also necessarily provided at the lower ends of frame members 32 and 36, and guide members 46 and 48, for the purpose of preventing disconnection of the various slidably connected members in the extended position.

The material employed for the guide members can be the same as that employed for frame members 32 and 36. However, the material of the guide members is not particularly critical since such guide members bear little or no weight in opearation of the apparatus. The cross-sectional shape of the guide members should be the same as the shape of frame members 32 and 36.

Receptacle 52 should be sized to fit through ceiling opening 20, and is shown as having a closed bottom, sidewalls for enclosing objects held in the receptacle, and an open top. The illustrated receptacle has a tubular frame construction with wire mesh forming the sidewalls, and a plate, preferably aluminum or steel, as the bottom of the receptacle. An object such as a box or other similar item can be easily placed in and held by receptacle 52, as indicated by the dashed lines at 58.

Fixedly mounted to frame member 40 is a motor 60 and drive shaft bearings 62 and 64. Motor 60 is preferably electrically operated, such as by AC house current, and most typically has a horsepower rating of about ½ to about 1 HP for lifting loads of up to a few hundred pounds in home use. Bearings 62 and 64 rotatably support drive shaft 66 which is rotated by motor 60 through a gear reduction box 68. Gear reduction box 68 would include in the illustrated embodiment at least a first gear directly driven by motor 60, and additional gear(s) at right angles to and operably connected to the first gear for driving drive shaft 66. Pulleys 70 and 72 are connected to opposite ends of drive shaft 66 immediately above respective upper ends 32*b* and 36*b,* which are open.

A cable 74 substantially vertically extends between and is connected to pulley 70 and receptacle 52 so as to be substantially vertically movable by rotation of pulley 70. As shown, cable 74 extends from pulley 70 and through frame member 32, guide member 46, and guide member 50. Similarly, cable 76 substantially vertically extends between and is connected to pulley 72 and receptacle 52 so as to be substantially vertically movable by rotation of pulley 72, and extends from pulley 72 through frame member 36, guide member 48, and guide member 54. Passing the cables through the frame members and guide members as shown serves to protect the cables from damage, and also to prevent a user or objects being loaded from becoming entangled with the cables. Therefore, cables 74 and 76 as connected between the pulleys and receptacle enables raising or lowering of the receptacle, and any objects held therein, through ceiling opening 20 by rotation of the pulleys and winding of the cables upon the pulleys.

Figure 2:
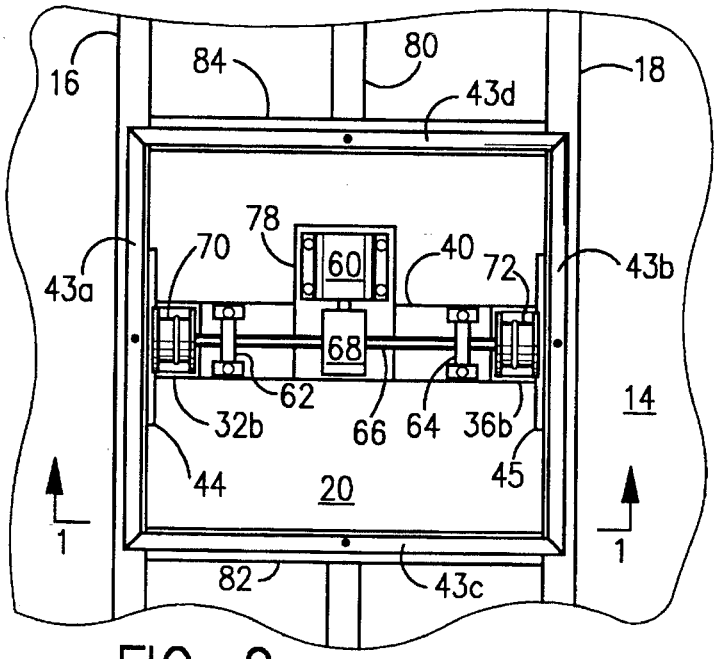
FIG. 2 is a top view of the lift apparatus as viewed along line 2—2 in FIG. 1.

Referring now to FIG. 2, this top view more clearly shows the relative positions of motor 60 and gear reduction box 68.

Motor 60 is mounted to frame member 40 by means of a plate 78, which is fixedly conected to frame member 40 by, for example welds, and which extends outwardly from frame member 40. FIG. 2 also shows additional joists 80, 82, and 84, as well as additional flange portions 43*c* and 43*d* which are at right angles to flange portions 43*a* and 43*b* and which lie along and in contact with joists 82 and 84, respectively.

Figure 3:
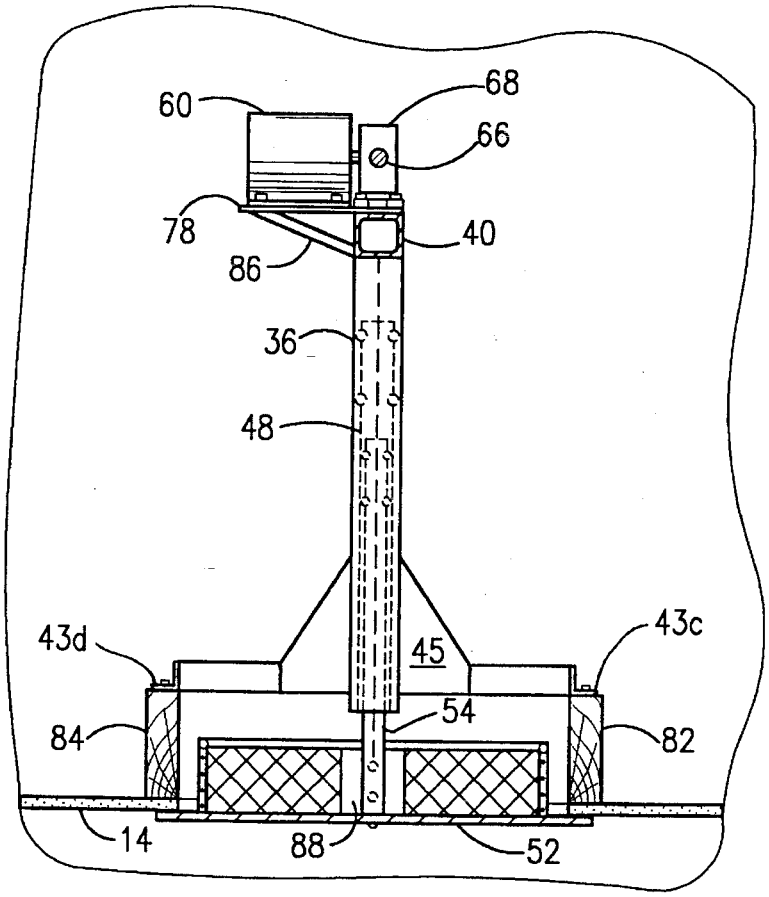
FIG. 3 is a partial cross-sectional view of the lift apparatus in its retracted position as viewed along a line perpendicular to line 2—2 in FIG. 1.

Referring now to FIG. 3, this view of the apparatus shows a motor support member 86 connected between plate 78 and frame member 40, brace 45 as being a generally "V" shaped member to provide stability to the frame, as well as guide member 48, guide member 54, and receptacle 52 in the retracted position substantially above ceiling level. FIG. 3 also more clearly shows connection of guide member 54 to receptacle 52 by means of a connecting plate 88 connected to guide member 54 by means of bolts.

With respect to installation, if the entire frame 31 is an integral unit as is shown in the illustrated embodiment, the frame and associated guide members (without receptacle 52 attached) can be turned upside down in interior room 10 and then manipulated through ceiling opening 20 by fitting flanged frame member 43 diagonally through ceiling opening 20. A rectangular, rather than square, ceiling opening and flanged frame member can make fitting the frame through the ceiling opening even easier. Alternatively, the frame could be a two piece unit having the flanged frame member connectable to the braces by means of bolts after the flanged frame member and the integral remainder of the frame are lifted through the ceiling opening to the attic. After installation of the frame and associated guide members, other components such as motor 60 can be mounted to frame member 40, and receptacle 52 can be connected to guide members 50 and 54.

In using the illustrated lift apparatus, motor 60 can be operated in a conventional manner similar to the motor in a garage door opener, employing a push button switch and limit switching means (not shown) to turn off motor 60 when the lift apparatus reaches its retracted and extended positions. Motor 60 can also incorporate a conventional stop mechanism to hold shaft 66, and consequently receptacle 52, in a fixed position when motor 60 is turned off.

It should be apparent from the above description that a homeowner can use the lift apparatus to safely and easily lift objects to attic 22 or lower objects from attic 22, while using a separate ceiling opening and associated ladder (not shown) to safely climb into or from the attic 22 without having to carry the objects.

Obviously, many modifications and varaiations of the present invention are possible in light of the above teachings. It is, therefore, to be understood that within the scope of the appended claims, the invention may be practiced otherwise than as specifically described. For example, according to certain broad aspects of the invention, the guide members and frame members described above as tubular could be nontubular and slidably cooperate in a nontelescopic manner, such as in a tongue and groove relationship.

That which is claimed is:

1. A lift apparatus for raising or lowering objects relative to a ceiling which is at a vertical level herein denoted as ceiling level, wherein the ceiling has a ceiling support means associated therewith and an opening therethrough having opposing sides, said lift apparatus comprising:

a receptacle, for holding the objects, which is sized to fit through the ceiling opening;

a frame, mounted to and supported by the ceiling support means in a fixed position, which includes (i) an elongated and substantially vertically oriented first frame member having a lower end in close proximity to one side of the ceiling opening and also having an upper end, (ii) an elongated and substantially vertically oriented second frame member having a lower end in close proximity to the other, opposing side of the ceiling opening and also having an upper end, and (iii) a third frame member, positioned above the ceiling opening, extending substantially horizontally between and fixedly connected to the first and second frame members near or at the upper ends of the first and second frame members;

a movable guide means fixedly connected to the receptacle for slidably cooperating with at least one of the first or second frame members so as to allow substantially vertical movement of the receptacle between a retracted position, at which the receptacle and movable guide means are substantially above ceiling level, and an extended position, at which the receptacle and movable guide means are substantially below ceiling level;

a drive means, including a pulley and a means for rotating the pulley, mounted to the third frame member;

a cable substantially vertically extending between and connected to the pulley and the receptacle so as to be substantially vertically movable by rotation of the pulley to thereby raise or lower the receptacle, and any objects held therein, through the ceiling opening between the retracted and extended positions.

2. A lift apparatus as recited in claim 1 wherein the movable guide means includes an elongated and substantially vertically oriented first guide member slidably connected to the first frame member and an elongated and substantially vertically oriented second guide member slidably connected to the second frame member.

3. A lift apparatus as recited in claim 2 wherein the first frame member is a tubular member having a longitudinal axis and the first guide member is a tubular member substantially coaxially and telescopically received by the first frame member, and further wherein the second frame member is a tubular member having a longitudinal axis and the second guide member is a tubular member substantially coaxially and telescopically received by the second frame member.

4. A lift apparatus as recited in claim 3 wherein the movable guide means further includes: a tubular third guide member slidably connected to the first guide member so as to be substantially coaxially and telescopically received by the first guide member, the third guide member having a lower end and being fixedly connected to the receptacle near or at such lower end; and a tubular fourth guide member slidably connected to the second guide member so as to be substantially coaxially and telescopically received by the second guide member, the fourth guide member having a lower end and being fixedly connected to the receptacle near or at such lower end.

5. A lift apparatus as recited in claim 4 wherein the upper ends of the first and second frame members are open, and wherein said pulley is herein denoted as the first pulley, which is positioned immediately above the open upper end of the first frame member, and said cable is herein denoted as the first cable, which extends from the first pulley and through the first frame member, first guide member, and third guide member, said lift apparatus further comprising: a second pulley, also rotated by said means for rotating, which is positioned immediately above the open upper end of the second frame member; and a second cable substantially vertically extending between and connected to the second pulley and the receptacle so as to be substantially vertically movable by rotation of the second pulley, the second cable extending from the second pulley and through the second frame member, second guide member, and fourth guide member.

6. A lift apparatus as recited in claim 5 wherein the means for rotating the first and second pulleys includes a motor and a drive shaft operably connected between the motor and the first and second pulleys.

7. A lift apparatus as recited in claim 6 wherein the ceiling support means includes a substantially horizontally extending first ceiling joist and a substantially horizontally extending second ceiling joist, and wherein the frame further comprises a flanged fourth frame member, fixedly connected to the first and second frame members at positions downwardly spaced from the third frame member, which includes at least first and second opposing and substantially horizontally extending flange portions which lie along and in contact with the first and and second ceiling joists, respectively, such that the first and second ceiling joists provide support to the frame.

8. A lift apparatus as recited in claim 7 wherein the frame is an integral unit sized relative to the ceiling opening to permit it to be passed through the ceiling opening from below ceiling level to above ceiling level to thereby permit ease of installation.

9. A lift apparatus as recited in claim 8 wherein the receptacle has a closed bottom, sidewalls for enclosing objects placed in the receptacle, and an open top.

10. A lift apparatus as recited in claim 9 wherein a roof and associated roof joists are above ceiling level, and wherein the space defined between the roof and the ceiling is an attic.

11. A lift apparatus as recited in claim 10 wherein no frame member or any part thereof is connected to the roof or associated roof joists.

12. An apparatus comprising:

a frame which includes (i) an elongated first frame member having a longitudinal axis and opposing ends, (ii) an elongated second frame member having a longitudinal axis and opposing ends, wherein the longitudinal axis of the second frame member is substantially parallel to and substantially coplanar with the longitudinal axis of the first frame member, (iii) an elongated third frame member having a longitudinal axis substantially perpendicular to the longitudinal axes of the first and second frame members, and extending between and fixedly connected to the first and second frame members near or at one end of each of the first and second frame members, and (iv) a flanged fourth frame member, fixedly connected to the first and second frame members at positions spaced from the third frame member toward the other, opposing ends of the first and second frame members, the fourth frame member including at least two opposing flange portions that lie in a plane substantially perpendicular to the longitudinal axes of the first and second frame members;

an elongated first guide member having a longitudinal axis substantially parallel to the longitudinal axis of the first frame member and being slidably connected to the first frame member so as to allow movement of the first guide member relative to the first frame member in opposite directions substantially parallel to the longitudinal axis of the first frame member;

an elongated second guide member having a longitudinal axis substantially parallel to the longitudinal axis of the second frame member and being slidably connected to the second frame member so as to allow movement of the second guide member relative to the second frame member in said opposite directions.

13. An apparatus as recited in claim 12 wherein the first frame member is a tubular member and the first guide member is a tubular member substantially coaxially and telescopically received by the first frame member, and further wherein the second frame member is a tubular member and the second guide member is a tubular member substantially coaxially and telescopically received by the second frame member.

14. An apparatus as recited in claim 13, further comprising: a tubular third guide member slidably connected to the first guide member so as to be substantially coaxially and telescopically received by the first guide member; and a tubular fourth guide member slidably connected to the second guide member so as to be substantially coaxially and telescopically received by the second guide member.

15. A lift apparatus for raising or lowering objects relative to a ceiling which is at a vertical level herein denoted as ceiling level, wherein the ceiling has a ceiling support means associated therewith and an opening therethrough having opposing sides, said lift apparatus comprising:

a receptacle, for holding the objects, which is sized to fit through the ceiling opening;

a frame, mounted to and supported by the ceiling support means in a fixed position, which includes (i) an elongated and substantially vertically oriented first frame member having a lower end in close proximity to one side of the ceiling opening and also having an upper end, (ii) an elongated and substantially vertically oriented second frame member having a lower end in close proximity to the other, opposing side of the ceiling opening and also having an upper end, and (iii) a third frame member, positioned above the ceiling opening, extending substantially horizontally between and fixedly connected to the first and second frame members near or at the upper ends of the first and second frame members;

a movable guide means fixedly connected to the receptacle for slidably cooperating with at least one of the first or second frame members so as to allow substantially vertical movement of the receptacle between a retracted position, at which the receptacle and movable guide means are substantially above ceiling level, and an extended position, at which the receptacle and movable guide means are substantially below ceiling level;

a drive means mounted to the third frame member and including a motor fixedly mounted to the third frame member, a pulley, and a drive shaft operably connected between the motor and the pulley so as to rotate the pulley;

a cable substantially vertically extending between and connected to the pulley and the receptacle so as to be substantially vertically movable by rotation of the pulley to thereby raise or lower the receptacle, and any objects held therein, through the ceiling opening between the retracted and extended positions.

* * * * *